US005638750A

United States Patent [19]

Sato

[11] Patent Number: 5,638,750

[45] Date of Patent: Jun. 17, 1997

[54] PRINTING APPARATUS

[75] Inventor: Shiro Sato, Tokyo, Japan

[73] Assignee: Riso Kagaku Corporation, Tokyo, Japan

[21] Appl. No.: 604,922

[22] Filed: Feb. 22, 1996

[30] Foreign Application Priority Data

Feb. 24, 1995 [JP] Japan ..... 7-037071

[51] Int. Cl.[6] ..... B05C 17/08

[52] U.S. Cl. ..... 101/126; 101/127.1

[58] Field of Search ..... 101/126, 125, 101/127, 127.1

[56] References Cited

U.S. PATENT DOCUMENTS 4,184,428 1/1980 Hosoya ..... 101/128.4
4,708,057 11/1987 Hogenson ..... 101/126

FOREIGN PATENT DOCUMENTS 4-02665 10/1992 Japan .
4-341883 11/1992 Japan ..... 101/125

OTHER PUBLICATIONS

Patent Abstracts of Japan, vol. 013, No. 183 (M-820) (JP-A-01-011875), Apr. 1989.
Japanese Utility Model Publication (Kokoku) No. Hei. 5-36708.
Japanese Utility Model Laid-open (Kokai) No. Hei. 4-2665.

*Primary Examiner*—Edgar S. Burr
*Assistant Examiner*—Daniel J. Colilla
*Attorney, Agent, or Firm*—Cushman Darby & Cushman IP Group of Pillsbury Madison & Sutro, LLP

[57] ABSTRACT

A printing apparatus is provided, which comprises a platform, pressing member which is pivotably supported on the platform and capable of carrying a stencil on a side facing the platform, and a frame member. The frame member is disposed between the platform and the pressing member and movable together with the pressing member with a predetermined angle relative to the pressing member being kept constant until the frame member contacts a sheet of paper stacked on the platform, and may be given a biased force against movement to the pressing member. On the frame member, is disposed a paper holding means which can be a resilient sheet capable of sticking to and peelably holding a sheet of paper. After printing is over, the pressing member is raised. The frame member holds on the platform the uppermost sheet of paper that has been printed so as to be peeled off from the stencil. After peeled, the uppermost sheet of paper is held and raised by the paper holding means as the frame member is raised together with the pressing member. The paper holding means is elastically deformed by the rotation of the frame member and the weight of paper, and thus the raised sheet of paper takes an inclined form so that it can readily be taken out of the printing apparatus by operators.

2 Claims, 6 Drawing Sheets

PRINTING APPARATUS

Figure 1:
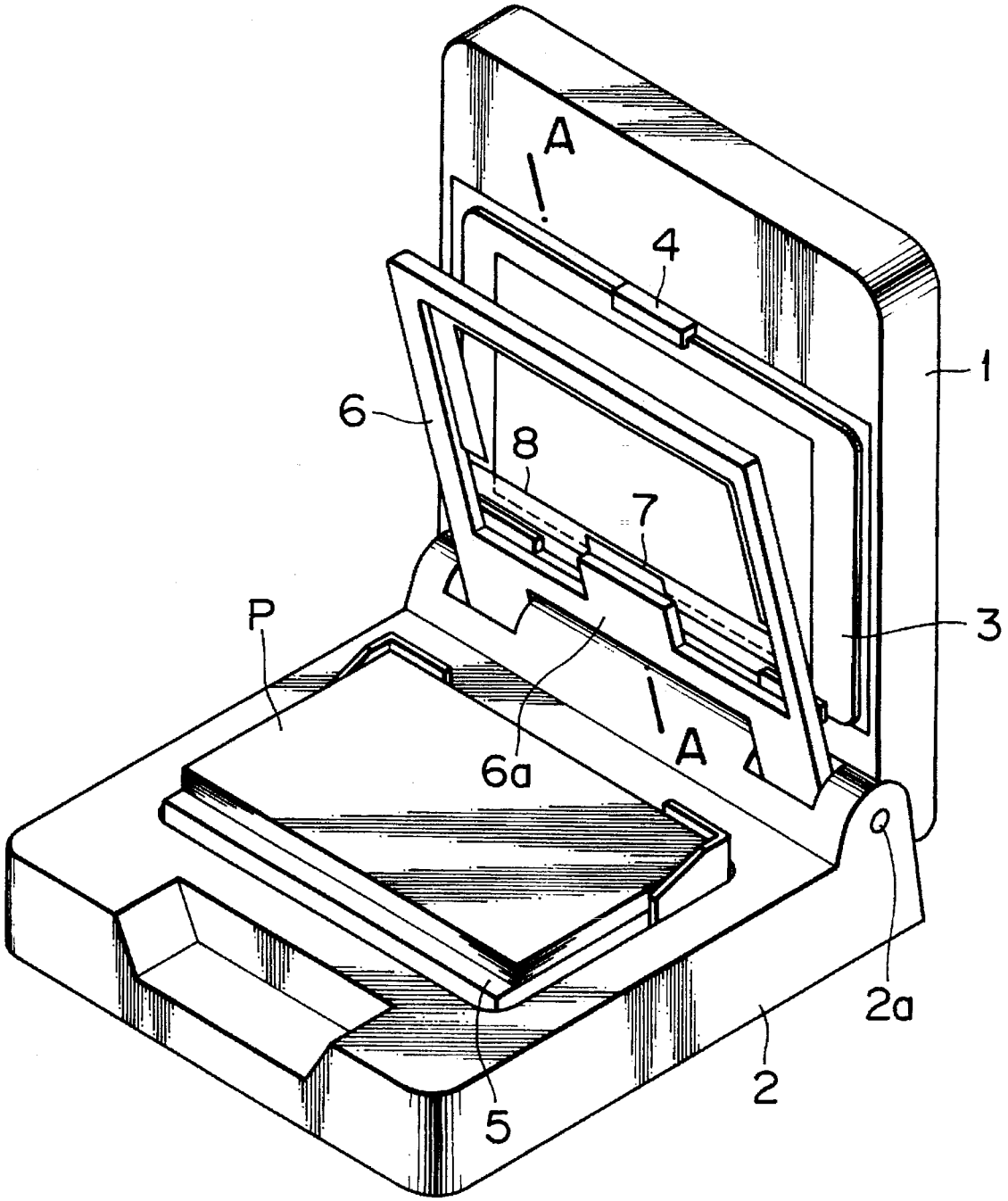

The present invention relates to a printing apparatus which comprises a platform on which several pieces of paper are placed, and a pressing means which is pivotably supported on the platform and is capable of carrying a stencil so that printing can be effected by rotating the pressing means to press the stencil to the paper placed on the platform. More specifically, the present invention relates to a printing apparatus of the type above, in which a printed piece of paper can readily be removed piece by piece from a stack of unprinted paper.

A portable printing apparatus is known, which comprises a platform having a mount on which printing paper is placed, and a pressing plate which is pivotably supported on the platform and to which a stencil can be attached on the side facing the platform, so that printing can be effected by attaching the stencil to the pressing plate and rotating the pressing plate toward the platform to press the stencil onto the printing paper.

In such a printing apparatus, the printed sheet of printing paper often sticks to the stencil due to stickiness of printing inks and is raised together with the pressing plate, when the pressing plate is rotated away from the platform after printing. In such a case, the printing paper has to be peeled from the stencil by hand, but there it often occurs that hands are stained with inks, or that the printed paper and the stencil are rubbed with each other to damage printed images.

In order to avoid the problems mentioned above, a printing apparatus has been proposed, in which a frame member is disposed between the pressing plate and the mount for peeling off the printed sheet of printing paper from the stencil. The frame member is a rectangular member which can hold the four edges of rectangular printing paper. The frame member is mounted to a shaft which connects the pressing plate with the platform. The frame member can rotate about the shaft together with the pressing plate while the frame member keeps constant a predetermined angle with the pressing plate, supposed to be of θ degree. A spring is interposed on the shaft between the frame member and the pressing plate, so that the frame member can rotate to approach the pressing plate while compressing the spring.

After printing has been made, the pressing plate is upwardly moved away from the mount. The frame member remains to contact the mount until the pressing plate is rotated up from the mount around the shaft by the angle of θ degree. When the pressing plate is further rotated up, the frame member upwardly rotates keeping constant the angle of θ degree with the pressing plate. In other words, while the pressing plate is moved from the mount upwardly by the predetermined angle of θ degree, the printing paper that has stuck to the stencil on the pressing plate is peeled from the stencil.

The printed sheet of printing paper remains on the mount after it is peeled from the stencil by the frame member. The printed paper has to be removed from the mount by hand before the next printing is effected. In this moment, however, it also occurs that images on the printed paper are touched by fingers so that fingers are stained with inks and the images are damaged. In order to solve such a problem, Japanese utility model Laid-open No. 2665/92 (Japanese utility model application No. 41099/90) suggests a printing apparatus which comprises means for removing only the printed sheet of printing paper that has been peeled from the stencil by the frame, from the stack of printing paper placed on the mount. In this printing apparatus, the removing means is a sticky holding element disposed on the frame member of the aforementioned apparatus. According to that apparatus, part of the printed sheet of printing paper sticks to the frame member, and thus the printed sheet of paper is raised together with the frame member from the remaining sheet of paper placed on the mount as the frame member is rotated up after printing. However, this apparatus is disadvantageous in that if relatively stiff paper is used, it engages with the frame member and cannot readily be removed from the frame member.

The object of the present invention is to facilitate removal of a printed sheet of paper not only from unprinted sheets of paper but also from the frame member, in a printing apparatus of the type which presses a stencil onto a stack of several sheets of paper to effect printing and then automatically peels a printed sheet of paper from the stencil by use of a frame member.

The present invention provides a printing apparatus comprising a platform on which paper is placed, a pressing member which is pivotably supported on the platform and capable of carrying a stencil on a side facing the platform, a frame member which is disposed between the platform and the pressing member and movable together with the pressing member with a predetermined angle relative to the pressing member being kept constant until the frame member contacts the paper placed on the platform, but can exert a pressing force on the printing paper when the frame member contacts the printing paper with the angle relative to the pressing member being narrower than the above predetermined angle, and means for holding paper, which is disposed on the frame member, in which said paper holding means is resiliently deformable and capable of peelably holding a sheet of paper.

In the present invention, the paper holding means can be a resilient sheet-like member one end of which is fixed to the frame member and the other end of which is a free end provided with a sticky element capable of peelably holding a sheet of paper. The sheet-like member may be folded along a fold to form an angle between the above two ends, so that the angle can be resiliently changed by weight of paper held by the sticky element of said free end.

In the present invention, the pressing member maybe a pressing plate which has on the side facing the platform a portion engageable with a stencil assembly, and the platform may have a mount on which several pieces of paper may be stacked, as in the known portable printer.

According to the present invention, when the pressing member is pressed onto a stack of printing paper placed on the platform upon printing, an edge of the uppermost paper contacts the paper holding means which is disposed on part of the frame member on a surface facing the platform. After printing, the pressing member is first rotated away from the platform to the predetermined degree, and thereafter is further rotated up together with the frame member in the same direction. In the latter moment, the paper holding means sticks to and holds the uppermost sheet of paper that has been printed among the stack of papers placed on the platform. Also, the paper holding means is resiliently deformed by the rotation of the frame member and the weight of the paper printed. Consequently, the printed sheet of paper is held and raised by the paper holding means that has in part been elastically deformed, and thus takes an inclined form so that it can readily be taken out of the frame member by operators.

Figure 2A:
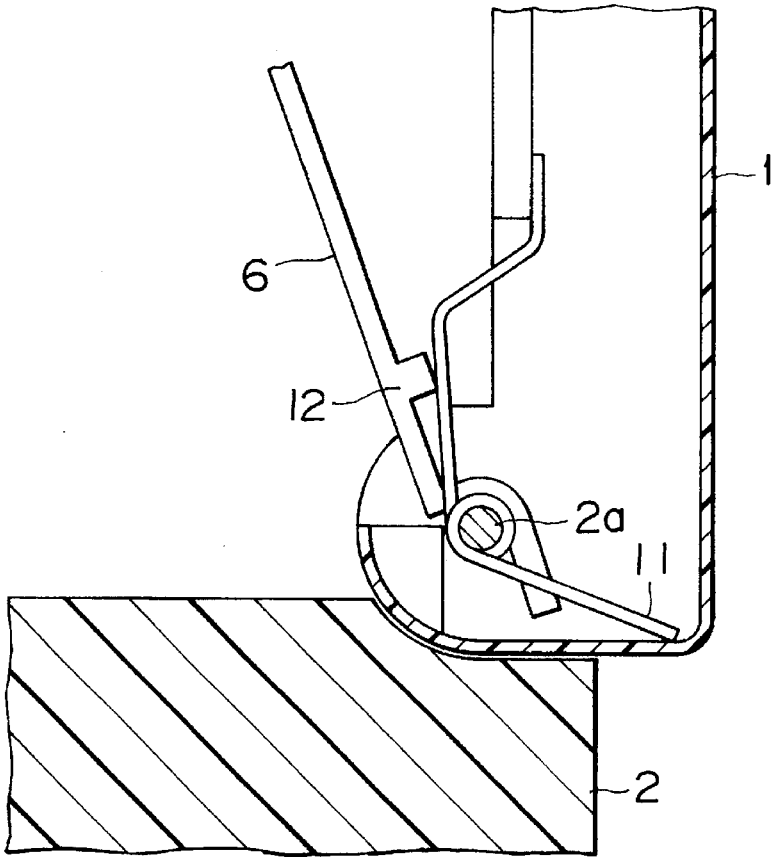
Figure 2B:
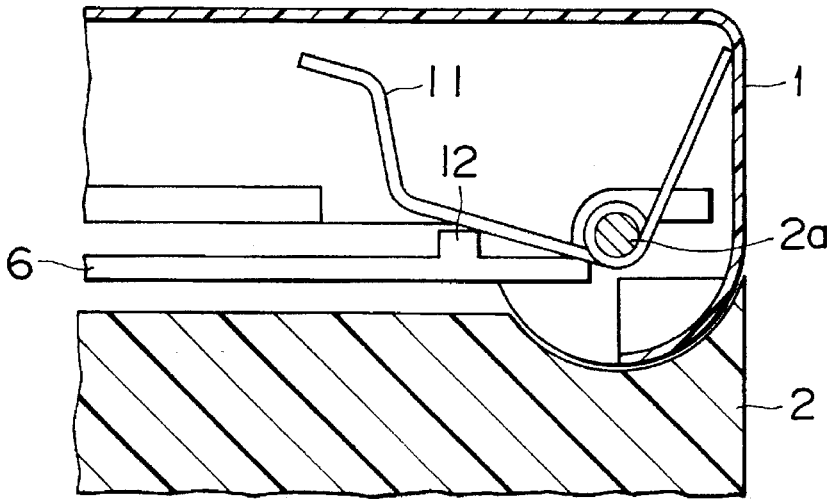
Figure 3A:
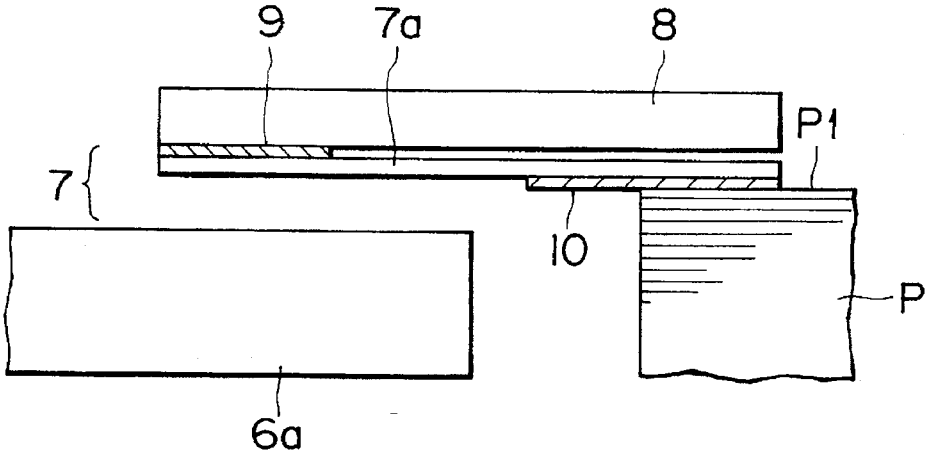
Figure 3B:
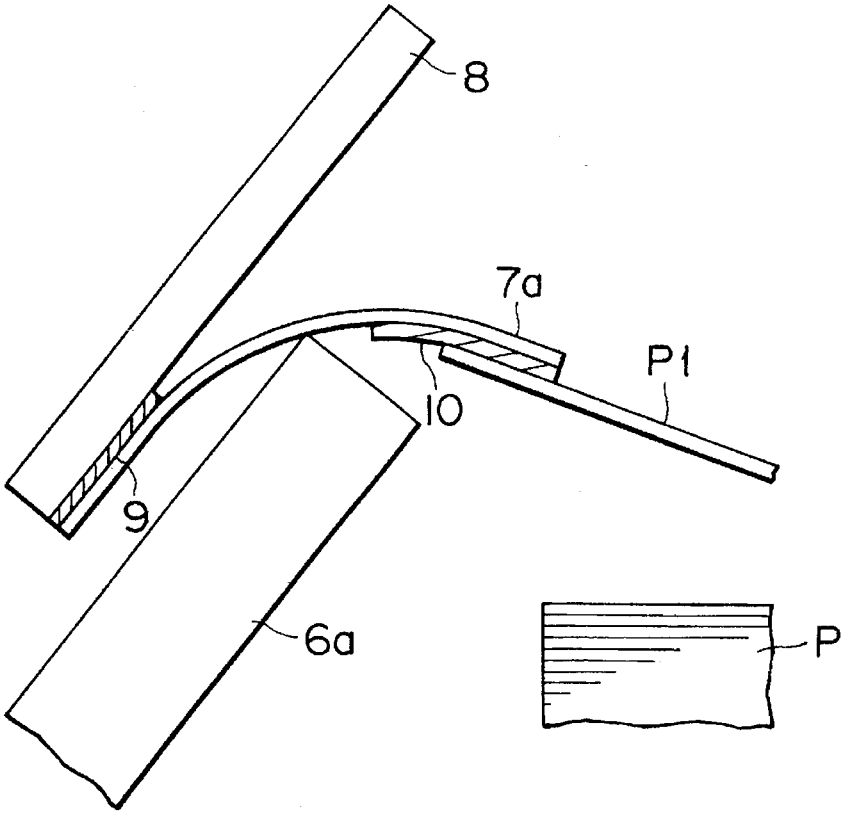
Figure 4:
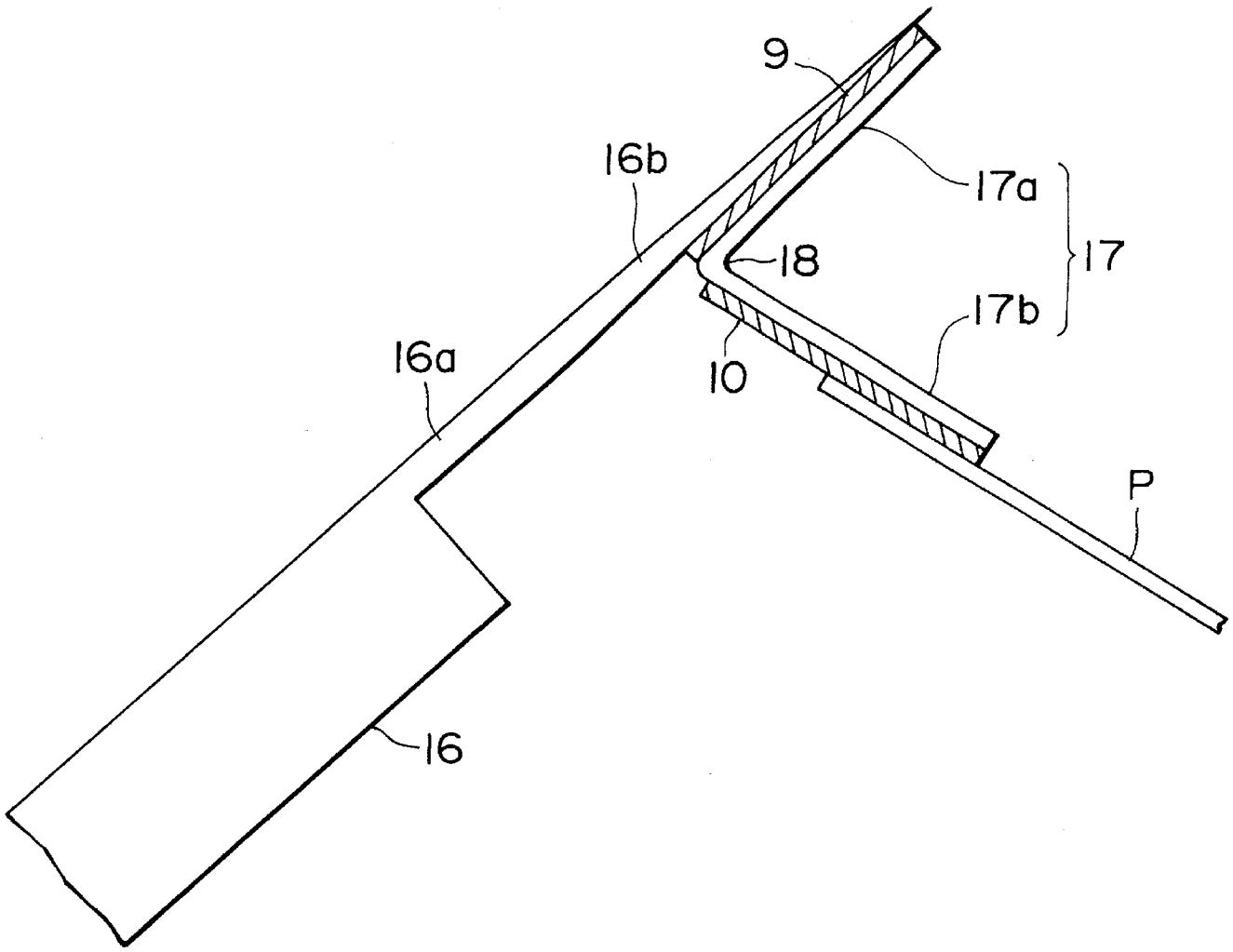
Figure 5:
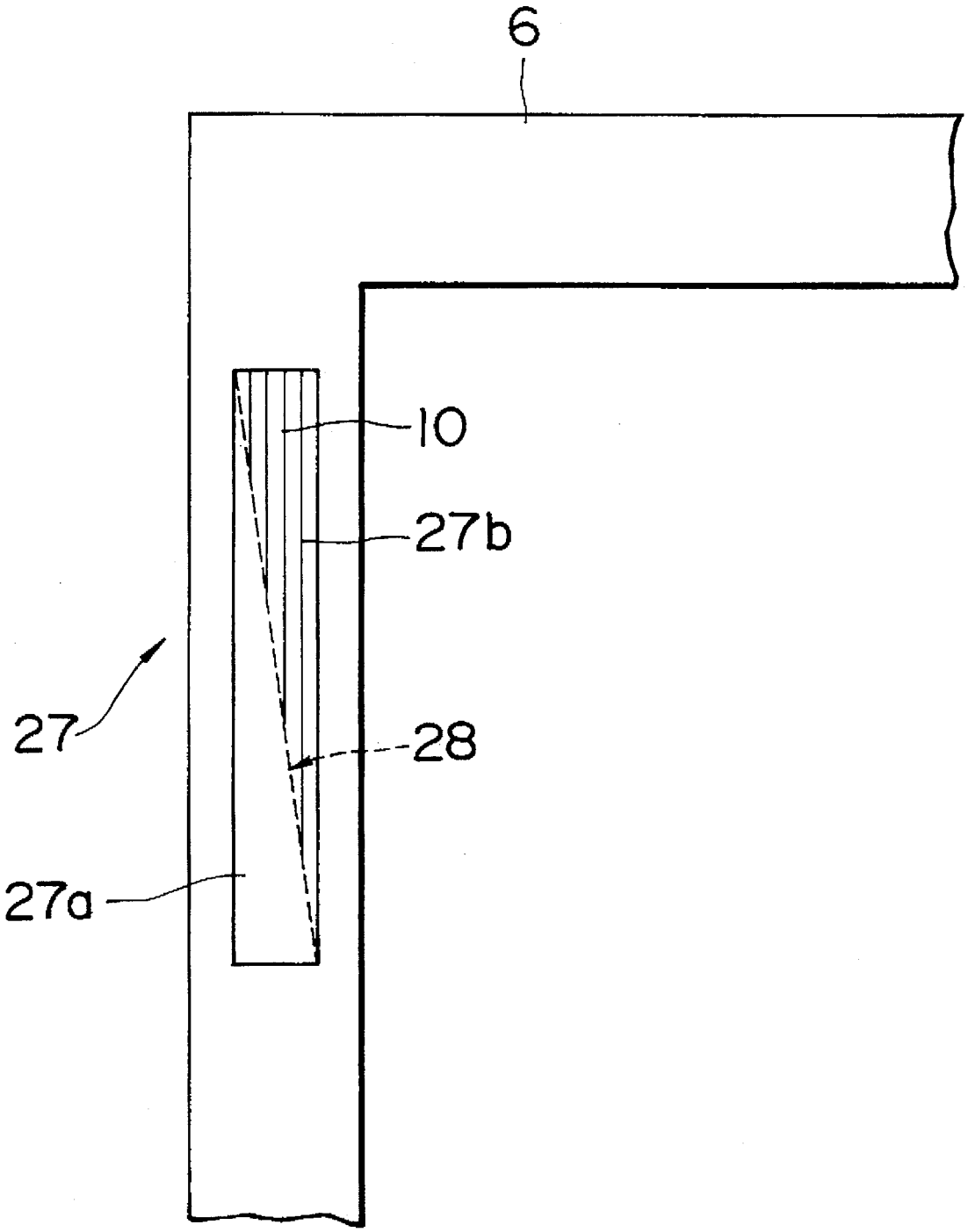
Figure 6:
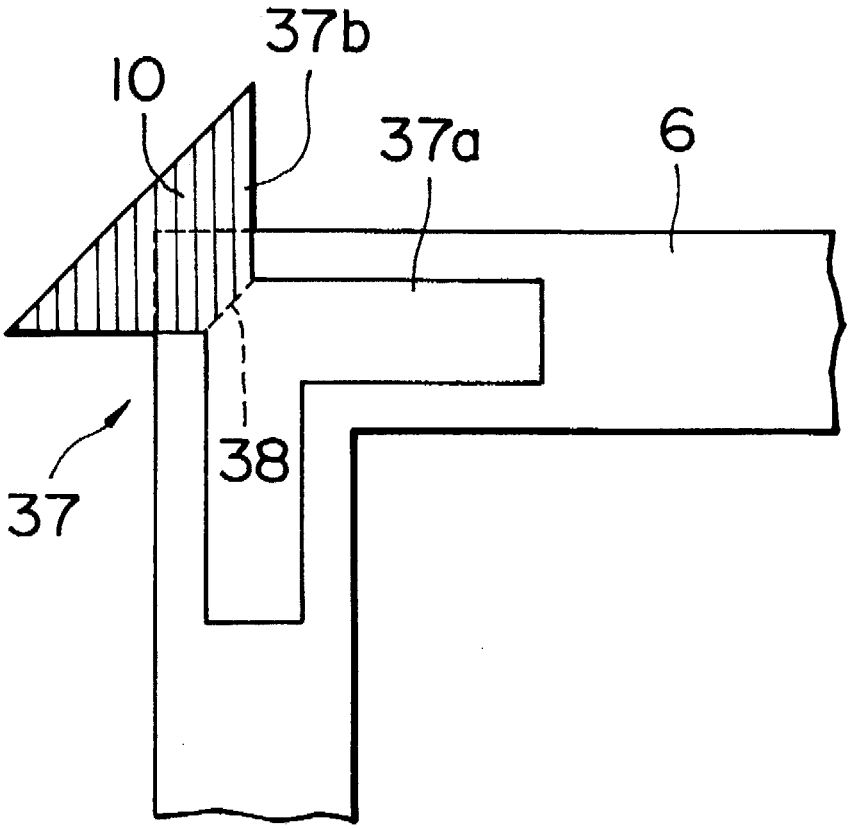

Hereinafter, presently preferred embodiments of the present invention will be described with reference to the accompanying drawings, in which FIG. 1 is a perspective view of the first embodiment of the present printing apparatus, FIGS. 2*a* and 2*b* are sectional views which illustrate the structure, the function and the like of a frame member and a pressing plate of the first embodiment of the present printing apparatus, FIGS. 3*a* and 3*b* are sectional views taken along the line A—A of FIG. 1, which illustrates the structure, the function and the like of a paper holding means in the first embodiment, FIG. 4 is an enlarged view of the second embodiment, showing a part of a frame member on which a paper holding means is disposed, FIG. 5 is an enlarged view of the third embodiment, showing a part of a frame member on which a paper holding means is disposed, and FIG. 6 is an enlarged view of the fourth embodiment, showing a part of a frame member on which a paper holding means is disposed.

Now referring to FIG. 1 to FIG. 3, the first embodiment of the present invention will be explained.

FIG. 1 is a perspective view which shows the present printing apparatus as a whole. The printing apparatus is an instant portable printer or duplicator having a pressing plate 1 and a platform 2. The pressing plate 1 is pivoted to the platform 2 about a shaft 2*a* provided at one side of the platform 2. The platform 2 has on its upper surface a paper mount 5 which is composed of a cushion member. Several sheets of printing paper P may be piled up on the paper mount 5. By virtue of the cushion member, the paper mount 5 can be compressed and elastically deformed by a pressing force which is exerted upon printing or so onto the printing paper P placed on the paper mount 5.

In FIG. 1, the pressing plate 1 is opened and rested away from the platform 2, forming an angle of about 90 degrees between the pressing plate 1 and the platform 2 around the shaft 2*a*. The pressing plate 1 is provided on the lower surface thereof with an engaging means 4 for detachably engaging the pressing plate 1 with a stencil assembly 3 which serves as a master for mimeographic printing. The stencil assembly 3 is held by the engaging means 4 so that an image portion of the stencil assembly 3 faces a desired region of the printing paper P placed on the paper mount 5 when the pressing plate 1 is rotated down and closed to the platform 2.

The stencil assembly 3 comprises a substantially rectangular frame on one side of which a mimeographic stencil sheet is stretched. The stencil assembly 3 also comprises a sheet impermeable to ink, which is laminated onto the other side of the frame. The ink-impermeable sheet is affixed at just one end thereof to the frame so that the sheet may readily be turned up from the frame. After the stencil sheet is processed to obtain a perforated stencil sheet, the ink-impermeable sheet is opened, printing inks are placed on the stencil sheet, and then the ink-impermeable sheet is again closed to wrap and envelope the inks in the frame. The stencil assembly 3 in which the inks have been enveloped is installed in the engaging means 4 of the pressing plate 1 to serve for printing.

The printing apparatus further comprises a separator 6 which is useful to make it easier to separate a printing paper P from the pressing plate 1 after printing has been made. The separator 6 is composed of a frame member which is detachably pivoted about the shaft 2*a* of the pressing plate 1 and has a rectangular window the circumference of which can hold all the four edges of the printing paper P. The separator 6 may be made of a material high in rigidity or transparency such as ABS or rubber-containing PMMA.

As shown in FIG. 2*a*, the separator 6 is associated with the pressing plate 1 at an predetermined angle, and can rotate together with the pressing plate 1, keeping this angle constant until the separator 6 contacts the printing paper P. Between the separator 6 and the pressing plate 1, is interposed a helical torsion spring 11 as means for biasing the separator 6. The spring 11 is installed around the shaft 2*a*, and applies a biasing force to the separator 6 so that the pressing plate 1 and the separator 6 cannot come close to each other with the above predetermined angle between them being narrower unless any force is applied against the biasing force.

As shown in FIGS. 2*a* and 2*b*, the separator 6 is provided on its side facing the pressing plate 1 with a protrusion 12 which is adjacent to the shaft 2*a*. The spring 11 contacts the separator 6 at this protrusion 12. When the pressing plate 1 is pressed toward the platform 2 to deform the spring 11, deformation of the spring 11 can be greater by the protrusion 12 than the case where the spring 11 would contact the separator 6 directly on its plane facing the pressing plate 1. Thus, as much increase in elastic force of the spring 11 is obtained, and the separator 6 can have a larger force to hold the printing paper when the pressing plate 1 is opened after printing is over. As the elastic force of the spring 11 is enhanced in this manner, the separator 6 can steadily hold the printing paper even on the edge which is furthest from the shaft 2a and first peels off from the stencil sheet when the printing paper is separated from the stencil assembly 3. In order to facilitate snap off of the stencil containing even much solid image, it is desirable to select a type of spring 11 or adjust the height of the protrusion 12 so that the separator 6 can hold the printing paper at a pressure of, for example, about 200 grams as measured by a spring balance.

Upon printing, the pressing plate i is rotated toward the platform 2 until the stencil assembly 3 is pushed against the printing paper P. Then, the separator 6 holds the periphery of the printing paper P while the separator 6 is sandwiched between the pressing plate 1 and the printing paper P. After printing, the pressing plate 1 is upwardly rotated so as to be separated from the printing paper, but the separator 6 still holds the printing paper P on the platform 2 by the aid of the biasing force of the spring 11 until the angle between the pressing plate 1 and the separator 6 returns to the above predetermined degree. Consequently, the printing paper P thus printed is kept on the paper mount 5 while it is peeled from the stencil assembly 3.

As shown in FIG. 1, the separator 6 is provided on its surface remote from the platform 2 with a supporting tape 8 which spans the window in parallel with the side of the window adjacent to the shaft 2*a*. The supporting tape 8 of this embodiment may be made of polyethylene terephthalate (PET). The supporting tape 8 is provided in the center of the side facing the platform 2 with a picking-up sheet 7. The picking-up sheet 7 is a resiliently deformable element which can peelably held the printing paper P, and thus serves to have the printing paper P held by the separator 6 which is moving upwardly after printing.

As shown in FIGS. 3*a* and 3*b*, the picking-up sheet 7 is affixed, at an end adjacent to the shaft 2*a*, to the supporting tape 8 with an adhesive 9, so that the picking-up sheet 7 is supported like a cantilever by the tape 8. The other end of the picking-up sheet 7 as a free end 7*a* is adapted to be positioned overlapping an edge of the printing paper placed on the platform 2, when the pressing plate 1 is pushed against the platform 2. The picking-up sheet 7 is provided at the free end 7*a* on the surface facing the platform 2 with a peelable element 10. The peelable element 10 can be made of, for example, a polyester sheet which is sticky on both sides. Such a polyester sheet should have on the side contacting the picking-up sheet 7 an adhesive layer having a strong adhesion, and on the opposite side, a peelably sticky or self-stick removable layer which a printing paper can be repeatedly attached to or peeled from.

The picking-up sheet 7 and the supporting tape 8 each should have a thickness to an extent that does not affect printing, and were respectively 50 μm and 250 μm in thickness in this embodiment. The picking-up sheet 7 may be adapted to readily be replaced by removing the supporting tape 8 as a whole and replacing it with a new one when adhesion of the peelable element 10 becomes insufficient due to aging, cohesion of paper powders or the like.

Hereinafter, operation of the printing apparatus of this embodiment will be explained. Several pieces of printing paper P are placed on the paper mount 5 of the platform 2. The stencil assembly 3 in which an ink has been enveloped is attached to the pressing plate 1 by use of the engaging portion 4. The separator 6 is installed in the printing apparatus. When the pressing plate 1 is kept in a position furthest from the platform 2, the pressing plate 1 is at an angle of about 90 degree with the platform 2. In this state, the separator 6 is at an angle of about 60 degree with the platform 2. Then, the pressing plate 1 is rotated toward the platform 2. While the pressing plate 1 is rotated, the separator 6 first rotates with an angle of 30 degree relative to the pressing plate 1 being maintained. After the separator 6 contacts the uppermost paper P1 of the stack of papers placed on the platform 2, only the pressing plate 1 is rotated with the spring 11 being deformed.

Then, printing is effected by pushing the pressing plate 1 against the platform 2 so as to press the stencil assembly 3 onto the printing paper P. In this instance, the peelable element 10 of the picking-up sheet 7 sticks to the uppermost printing paper P1 along the paper's edge adjacent to the shaft 2*a*.

After printing is over, the pressing plate 1 is raised. Until the angle between the pressing plate 1 and the platform 2 is returned to about 30 degree, pressing force is exerted on the printing paper P via the separator 6 by the spring 11 to hold the paper P on the platform 2. As a result, the stencil assembly 3 is peeled from the printing paper P that is held on the platform 2, while the stencil assembly 3 is rotated upwardly with the pressing plate 1.

When the pressing plate 1 is rotated up to form an angle of about 30 degree or more with the platform 2, the separator 6 starts rising together with the pressing plate 1. The printing paper P1 already printed is also elevated with the separator 6 being raised, as it is carried at an edge thereof by the peelable element 10 of the picking-up sheet 7. In this moment, the picking-up sheet 7 is curved by elevation of the separator 6 and weight of the printing paper P1, and then comes into contact with the central portion 6*a* of the separator 6. The printing paper P1 that has been peeled from the stencil assembly 3 is kept to be raised by the separator 6 to take a substantially inclined form hanging from the deformed picking-up sheet 7. In this state, the printing paper P1 can readily be picked up by fingers, and thus the printed paper P1 can readily be taken out of the apparatus without returning the pressing plate 1 to the furthest position. After the printing paper P1 is peeled from the peelable element 10, the picking-up sheet 7 restores the initial shape.

Hereinafter, the second embodiment of the present printing apparatus will be explained. The basic structure of the printing apparatus of the second embodiment is the same as the first embodiment, except the separator 16 is characteristic of the second embodiment. Thus, referring to FIG. 4, only the separator 16 and the picking-up sheet 17 attached to the separator 16 will explained. In this embodiment, the central portion of 16*a* of the separator 16 has an extended edge portion 16*b* which is thinner than the central portion 16*a* and provided with the picking-up sheet 17. The picking-up sheet 17 is a hinge-like member which is foldable along a fold 18. The fold 18 divides the picking-up sheet 17 in one half 17*a* and the other half 17*b* both of which are connected at an predetermined angle with each other. The one half 17*a* of the picking-up sheet 17 is affixed to the edge portion 16*b* with an adhesive 9. The other half 17*b* of the picking-up sheet 17 is provided with the peelable element 10. When the printing paper P is caught by the peelable element 10, the angle between the one half 17*a* and the other half 17*b* is resiliently deformed by the weight of the printing paper P. Accordingly, substantially the same effect as in the first embodiment is obtained in this embodiment. Since the picking-up sheet 17 is attached directly to the separator 16 in this embodiment, it is not required to be disposed via the supporting tape 8 on the separator 16 as in the first embodiment.

Hereinafter, the third embodiment of the present printing apparatus will be explained. The basic structure of the printing apparatus of the third embodiment is the same as the first embodiment, except the picking-up sheet 27 is characteristic of the third embodiment. Thus, referring to FIG. 5, only the picking-up sheet 27 will explained. In the first and second embodiments, the picking-up sheet 7, 17 is disposed on the frame-like separator 6, 16 along an edge which is adjacent to and in parallel with the shaft 2*a*. In the present invention, however, the picking-up sheet may be disposed anywhere on the frame-like separator as long as the picking-up sheet can contact the edge of the printing paper. Accordingly, the picking-up sheet 27 having a substantially rectangular shape is disposed on one of the two edges of the separator 6, which, among the four edges, extend in a direction transverse to the shaft 2*a*, as shown in FIG. 5. The picking-up sheet 27 can be a sheet made from a resilient resin or the like. The picking-up sheet 27 is foldable along a fold 28 which extends along a diagonal line of the sheet 27 and which divides the picking-up sheet 27 in one half 27*a* and the other half 27*b*. The one half 27*a* is affixed onto the separator 6, and the other half 27*b* as a free end is provided with a peelable element 10 shown in FIG. 5 with hatching. The fold 28 of the picking-up sheet 27 is resilient. Thus, as the separator 6 is elevated carrying the printing paper P on the peelable element 10 and the angle of the fold 28 is deformed, the printing paper P is raised and takes an inclined form. Accordingly, substantially the same effect as in the first embodiment can be obtained in this embodiment.

Hereinafter, the fourth embodiment of the present printing apparatus will be explained. The basic structure of the printing apparatus of the fourth embodiment is the same as the first embodiment, except the picking-up sheet 37 is characteristic of the fourth embodiment. Thus, referring to FIG. 6, only the picking-up sheet 37 will explained. In the fourth embodiment, the picking-up sheet 37 is disposed on a corner of the frame-like separator 6. The picking-up sheet 37 is a sheet made of an elastic resin or the like. The picking-up sheet 37 consists of two portions, one of which is an L-shaped portion 37*a* fixed at the corner of the separator, and the other of which is a substantially triangle portion 37*b* having a peelable element 10. The two portions 37*a* and 37*b* are connected together by a fold 38. The fold 38 of the picking-up sheet 37 has resiliency. In FIG. 6, the triangle portion 37*b* is provided on the side facing the separator 6 with a weakly sticky layer to form the peelable element 10. In use, the triangle portion 37*b* is folded along fold fold 38 toward the L-shaped portion 37*a*. When the separator 6 is raised with a printing paper P being held by the triangle portion 37*b*, the angle of the fold 38 between the two portions 37*a* and 37*b* is deformed, and the printing paper P thus held is raised to take an inclined form. Accordingly, substantially the same effect as in the first embodiment can be obtained in this embodiment.

According to the present invention, means for holding the uppermost sheet of paper is provided with the frame member or separator, which is resiliently deformable with rotation of the frame member and the weight of the paper. As a result, the paper printed can be raised while taking a substantially inclined form, and thus operators can readily pick up the paper to take it out of the printing apparatus. After the paper is removed, the paper holding means restores the initial shape and thus immediately gets ready for the next printing.

I claim:

1. A printing apparatus comprising:

a platform on which paper is to be placed, a pressing member pivotably supported on the platform and constructed and arranged to carry a stencil on a side facing the platform, a frame member disposed between the platform and the pressing member constructed and arranged to pivot together with the pressing member until the frame member contacts paper which is placed on the platform, biasing means disposed between the pressing member and the frame member for biasing the frame member toward the paper when an angle between the pressing member and the frame member becomes less than a predetermined angle, and means for holding paper, which comprises a resilient sheet-like member having first and second ends, said first end being fixed to the frame member, said second end being a free end provided with a sticky element constructed and arranged to hold the paper such that the paper may be peelably removed therefrom.

2. A printing apparatus according to claim 1, wherein the sheet-like member is folded along a fold to form an angle between said first and second ends, so that the angle can be resiliently changed by weight of paper held by the sticky element of said free end.

* * * * *